US007565927B2

(12) United States Patent
Gerez et al.

(10) Patent No.: US 7,565,927 B2
(45) Date of Patent: Jul. 28, 2009

(54) MONITORING AN EXPLOSIVE DEVICE

(75) Inventors: David Gerez, Houston, TX (US); Cesar Da Gama, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 62 days.

(21) Appl. No.: 11/164,693

(22) Filed: Dec. 1, 2005

(65) Prior Publication Data

US 2007/0125540 A1 Jun. 7, 2007

(51) Int. Cl.
*E21B 43/1185* (2006.01)
*E21B 43/116* (2006.01)

(52) U.S. Cl. ..... 166/250.01; 166/297; 166/66; 166/55; 175/4.54

(58) Field of Classification Search ..... 166/250.01, 166/297, 298, 55, 55.1, 66; 175/2, 4.51, 175/4.54, 40

See application file for complete search history.

(56) References Cited

U.S. PATENT DOCUMENTS 4,345,650 A * 8/1982 Wesley ..... 166/249
4,886,126 A * 12/1989 Yates, Jr. ..... 175/4.54
4,971,160 A * 11/1990 Upchurch ..... 175/4.54
5,042,594 A * 8/1991 Gonzalez et al. ..... 175/4.55
5,050,675 A * 9/1991 Upchurch ..... 166/373
5,369,579 A * 11/1994 Anderson ..... 702/11
5,691,712 A * 11/1997 Meek et al. ..... 340/853.3
6,148,263 A 11/2000 Brooks
6,179,064 B1 * 1/2001 Vaynshteyn ..... 175/4.54
6,273,187 B1 * 8/2001 Voisin et al. ..... 166/63
6,412,573 B2 * 7/2002 Vaynshteyn ..... 175/4.54
6,672,382 B2 1/2004 Schultz
2002/0148611 A1 * 10/2002 Williger et al. ..... 166/297
2004/0165760 A1 8/2004 Veneruso
2005/0178282 A1 * 8/2005 Brooks et al. ..... 102/202.7
2006/0011278 A1 * 1/2006 Rezaie et al. ..... 149/92
2006/0023567 A1 * 2/2006 Uhl et al. ..... 367/13
2006/0249045 A1 * 11/2006 Goodman et al. ..... 102/305

OTHER PUBLICATIONS

Schlumberger, Wireline Perforating Platform, Bulletin PR_03_007_0, Nov. 2003, 2 pages, U.S.
Schlumberger, Wireline Perforating Platform Operations, WPP Level 2 TBT, Bulletin from Schlumberger Website, Oct. 15, 2005, 5 pages, U.S.

* cited by examiner

*Primary Examiner*—Shane Bomar
(74) *Attorney, Agent, or Firm*—Kevin B. McGoff; James L. Kurka

(57) ABSTRACT

An explosive device includes a housing, and at least one of an initiator and an explosive in the housing. The at least one of the initiator and explosive are activatable in response to stimulus from a control line. A monitor in the housing monitors a state of the stimulus to enable determination of a status of the explosive device.

32 Claims, 4 Drawing Sheets

MONITORING AN EXPLOSIVE DEVICE

TECHNICAL FIELD

The invention relates generally to monitoring an explosive device.

BACKGROUND

In completing a well, various operations are performed in the wellbore, including operations in which explosive devices are detonated. Examples of explosive devices include perforating guns, pipe cutters, tools for setting packers, and so forth.

Activating an explosive device in a wellbore relies on the fault-free operation of a relatively complex collection of individual subsystems. While each subsystem has been designed to achieve a target reliability level, the collection of the individual subsystems may produce an unacceptably high system failure rate. In particular, the electrical transmission path (from the earth surface down to the explosive device located downhole in the wellbore) presents particular difficulties, as failure mechanisms can be difficult to isolate, leading to multiple failed attempts at activating the explosive devices before the root cause is isolated and resolved. This problem is especially acute in the case of intermittent failures (such as due to short circuits), which may be present while the equipment is deployed downhole, but then disappear when the tools are brought to the more benign conditions of the earth surface for troubleshooting. Equipment may often be replaced and classified as defective unnecessarily when the fault disappears for an unrelated reason.

There are two fundamental approaches to monitoring the integrity of an electrical circuit during operations involving activation of explosive devices: (1) surface testing and (2) downhole testing. Surface testing involves testing the integrity of the system at the surface before deployment in the well, or possibly before redeployment if the equipment has been recovered for diagnostics as a result of a failure. Surface testing involves testing the electrical continuity or insulation integrity of specific subsystems (e.g., wireline, casing collar locator, firing head, and so forth). To perform a thorough system test, shooting power may sometimes be applied (shooting power refers to power that is at a sufficiently high level to activate the explosive device). However, performing such a test at the earth surface is hazardous due to possible inadvertent detonation of the explosive device at the earth surface.

Downhole testing often relies upon sophisticated testing equipment that are coupled to but are separate from the explosive device. However, such relatively sophisticated equipment are associated with relatively high costs that may not be practical in many situations.

SUMMARY OF THE INVENTION

In general, an explosive device comprises a housing, at least one of an initiator and an explosive in the housing, the at least one of the initiator and explosive capable of being activated in response to stimulus from a control line. A monitor in the housing is provided to monitor a state of the stimulus to enable determination of a status of the explosive device.

Other or alternative features will become apparent from the following description, from the drawings, and from the claims.

DETAILED DESCRIPTION OF THE INVENTION

Figure 1:
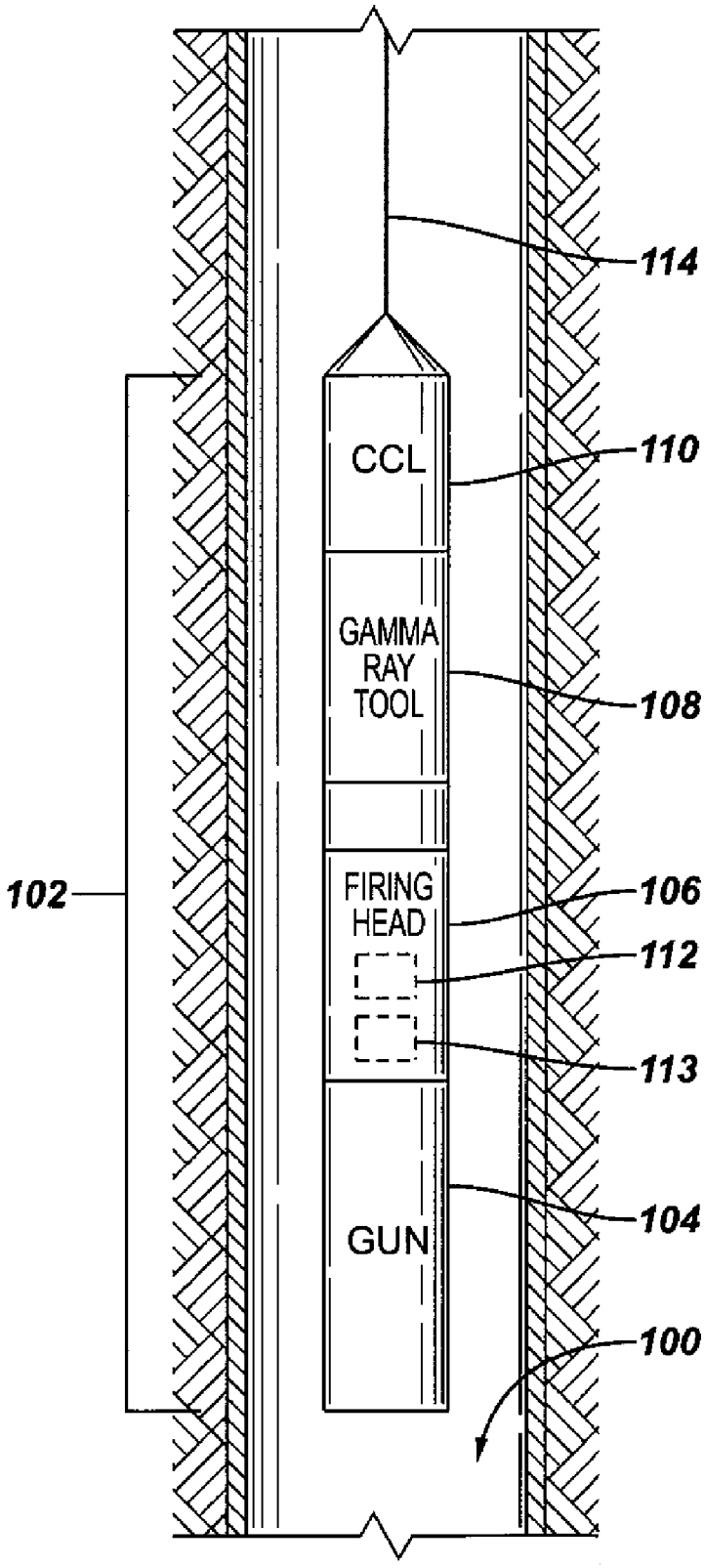
FIG. 1 illustrates a tool according to an embodiment deployed in a wellbore.

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

According to some embodiments, a monitor is provided within a housing of an explosive device to verify the integrity of a stimulus (e.g., an electrical signal, optical signal, etc.) provided to the explosive device. For example, the monitor can monitor the electrical signals (e.g., voltage, current, or both) entering an initiator in the explosive device before, during, and/or after activation of the explosive device. Also, the monitor is able to measure other downhole characteristics, such as temperature, pressure, depth of a tool containing the explosive device, acceleration of the tool, humidity level inside the tool and others. The monitor may also record data from several places inside and outside the tool, for example: temperature at certain points inside the tools for further comparison with temperature in other places, or determining a profile of temperature distribution along the tool. The various measured one or more characteristics are representative of a status of the explosive device (before, during and/or after detonation of the explosive device) or of the environment surrounding the explosive device. Although referred to in the singular sense, the term "monitor" is intended to cover one physical device or multiple physical devices (e.g., one sensor or multiple sensors).

The information pertaining to the state of the stimulus, as well as other downhole characteristics, can be transmitted to the earth surface in real time for evaluation and diagnostics. Alternatively, the information can be stored in a downhole storage device and retrieved to the earth surface at a later time for evaluation. That will be the typical case where several monitors are placed in the tool string collecting different types of information. It is also applicable when a gun string is run with slick line where there is no continuous data media transmission from downhole to surface. The monitor can be part of single-use equipment that is destroyed after detonation of the explosive device. Alternatively, the monitor can be part of equipment that is reusable (in other words, the equipment containing the monitor is not destroyed due to detonation of the explosive device).

The information provided by the monitor helps to improve reliability of operations involving detonation of explosive devices. By monitoring, while the tool is in the wellbore, the state of the stimulus provided for activating an explosive device, reliable feedback can be received regarding the status of the explosive device such that accurate diagnostics can be performed. Moreover, such information can be used for preventative maintenance to reduce likelihood of failures of other systems that include explosive devices.

FIG. 1 illustrates a tool 102 that is deployed in a wellbore 100. The tool 102 is carried into the wellbore by a carrier line 114 (which can be a wireline, slickline, coiled tubing, or other type of carrier). The carrier line 114 includes a cable (e.g., an electrical cable, fiber optic cable, a wire from another tool 102, etc.) for providing stimuli to the various components of the tool 102 for activating such components.

One of the components in the tool 102 is a gun 104 (such as a perforating gun). A gun 104 can include one or more carriers used to perforate one or more intervals in the well in the same descent. The other components of the tool 102 include a firing head 106 for activating the gun 104, a gamma ray tool 108 (for performing various investigations in the wellbore 100), and a casing collar locator (CCL) 110 for determining a depth of the tool 102 in the wellbore 100. Note that the CCL 110 and gamma ray tool 108 are optional components that can be omitted in other implementations of the tool 102. Moreover, other components (not shown) can be part of the tool 102 in other implementations. Also, the order in which the different components are shown may be inverted (example, firing head 106 maybe located below gun 104).

In the embodiment depicted in FIG. 1, the firing head 106 includes a monitor 112 for monitoring a stimulus (or stimuli) provided down the cable (in the carrier line 114 for activating the gun 104). The stimulus, as noted above, can be an electrical signal or a fiber optic signal. An electrical signal used for activating an explosive device includes an electrical signal having a predetermined shooting voltage or shooting current. A predetermined shooting voltage may include voltage in excess of 500 volts, whereas a shooting current may include current in excess of 500 milliamperes.

The firing head 106 includes an initiator 113 that is ballistically coupled to the gun 104. In one example, the initiator 113 is able to initiate a detonating cord that is attached to shaped charges of the gun 104. In such an arrangement, the initiator 113 includes a detonator for starting the initiation of the detonating cord. In an alternative implementation, the gun 104 includes shaped charges that are activated by electrical signals. In this case, the initiator 113 produces an electrical signal for activating such shaped charges in the gun 104.

As used here, an "initiator" refers to any device that produces a signal for activating an explosive, such as the shaped charges of the gun 104 or other types of explosives. An explosive device refers to any device that contains either an initiator or explosive, or both. Thus, in the example of FIG. 1, the firing head 106 can be considered an explosive device, and the gun 104 can be considered an explosive device. Also, the assembly of the firing head 106 and gun 104 can collectively be considered an explosive device. In a different embodiment, the monitor 112 can be provided in the gun 104 instead of in the firing head 106.

Figure 2:
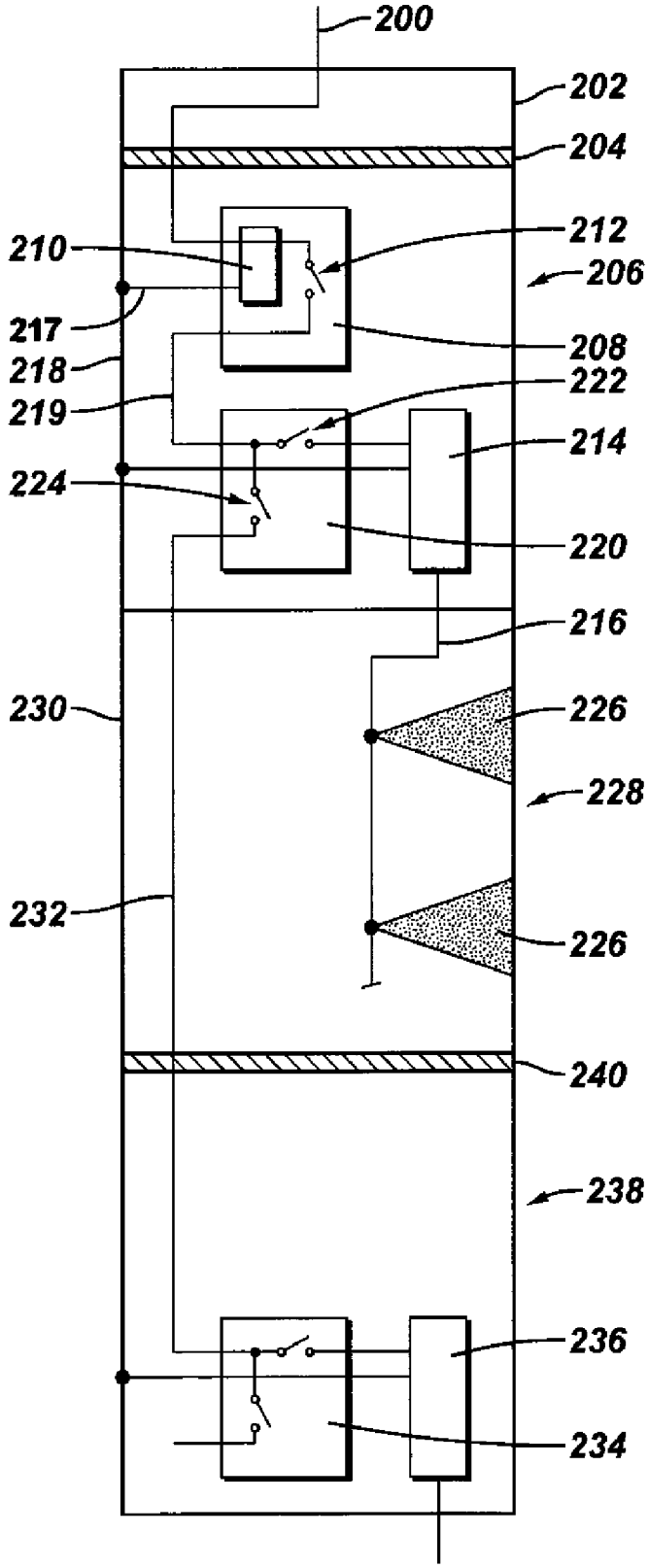
FIG. 2 illustrates a first arrangement of the tool in which a monitor is provided, in accordance with an embodiment.

FIG. 2 illustrates an example arrangement of firing heads and a perforating gun (only one perforating gun illustrated). A cable 200 is shown coupled to a cable head 202. The cable 200 can be provided in the carrier line 114 (FIG. 1) and provided through other components in a tool, such as tool 102. The cable head 202 is attached through a pressure bulkhead 204 to a firing head 206. The firing head 206 contains a monitor 208 that includes a measurement module 210 and an optional cable switch 212. The cable switch 212 is in the open position to isolate a stimulus in the cable 200 from a cable or control line segment 219 connected to an addressable switch 220 in the firing head 206. For example, the stimulus can be a shooting voltage that is capable of causing activation of an initiator 214 connected to the addressable switch 220.

In the depicted implementation, the measurement module 210 is electrically connected to a ground 217, which can be provided by a housing 218 of the firing head 206. Note that the monitor 208 is contained within the housing 218 of the firing head.

In the arrangement of FIG. 2, the monitor 208 is considered to be located within the housing of an explosive device, in this case the firing head 206. Also, the monitor 208 can be considered to be contained in a housing of an explosive device that includes both the firing head 206 and the perforating gun 228. The perforating gun 228 has a housing 230 that contains a detonating cord 216 and shaped charges 226. Although the housing 230 of the perforating gun 228 and housing 218 of the firing head 206 are separate housing segments, the two housings 230 and 218 can be considered as one housing of an explosive device (that contains the firing head 206 and perforating gun 218).

The monitor 208 is further coupled to the addressable switch 220 that is selectably addressable by signaling provided over the cable 200. For example, the addressable switch 220 can be associated with a unique address, with the address contained in the signaling provided over the cable 200 to cause the addressable switch 220 to respond. The addressable switch 220 includes an initiator enable switch 222 that remains open until the addressable switch 220 is addressed by signaling that contains the address of the addressable switch 220. In response to receipt of signaling containing the address, the initiator enable switch 222 is activated to a closed position. The addressable switch 220 also contains a cable switch 224 that remains open to isolate components further down the tool depicted in FIG. 2. Note that in a different implementation, the cable switch 224 can be provided outside the addressable switch 220. Other implementations may omit the addressable switch 220. If a single perforating gun 228 is to be fired, the initiator 214 can be directly connected to the monitor 208 through the control line segment 219. If multiple perforating guns are to be fired, other types of devices can be used in place of the addressable switch 220; these include a diode that allow only the correct polarity of shooting voltage to reach initiator 214, or a mechanical switch that connects initiator 214 to the monitor 208 upon sensing the mechanical acceleration resulting from the firing of firing head 238.

The initiator enable switch 222 when closed couples a stimulus provided over the cable 200 and through the cable switch 212 (if the cable switch 212 is closed) to the initiator 214. The initiator 214 is ballistically coupled to a detonating cord 216. The initiator 214 in this arrangement includes a detonator (which in one embodiment contains an explosive) that when activated by the stimulus causes an initiation to occur in the detonating cord 216. Initiation of the detonating cord 216 causes detonation of shaped charges 226 of a perforating gun 220. Alternatively, instead of using the detonating cord 216, an electrical line can be provided from the initiator 214 to electrically-activatable shaped charges 226, with an electrical signal provided through the electrical line to activate the shaped charges 226.

The addressable switch 220 is further coupled by a cable or control line segment 232 (e.g., electrical line) to another addressable switch 234, which contains the same components as the addressable switch 220. Also, the addressable switch 234 is coupled to an initiator 236 in the same manner as the initiator 214 to the addressable switch 220. The addressable switch 234 and initiator 236 are part of a firing head 238 that is coupled to another perforating gun (not shown in FIG. 2). The firing head 238 is separated from the perforating gun 228 by a pressure bulkhead 240.

In operation, the lower firing head 238 is activated first to fire its associated perforating gun. To do so, signaling is provided to close the optional cable switch 212 in the monitor 208 and cable switch 224 in the addressable switch 220. Signaling is then provided down the cable 200, where such signaling contains the unique address of the addressable switch 234. This signaling causes the initiator enable switch in the addressable switch 234 to close. Next, a stimulus (e.g., shooting power) is provided over the cable 200 and transferred through the cable switches 212 and 224, cable segment 232, and initiator enable switch of the addressable switch 234 to the initiator 236. Shooting power refers to either shooting voltage, shooting current, or both. The shooting power causes activation of the initiator 236 to cause detonation of the perforating gun associated with the firing head 238. The shooting power (voltage, current, etc.) is monitored by the monitor 208.

Next, the tool depicted in FIG. 2 can be optionally moved to another location in a wellbore. Note that the cable switches 212 and 224 in the upper firing head 206 are opened prior to any such movement to avoid inadvertent detonation of the perforating gun 228. After the tool has been moved to a desired location, signaling is provided down the cable 200 to close the cable switch 212 in the monitor 208. Further signaling containing the address of the addressable switch 220 is then provided to close the initiator enable switch 222. A stimulus is then provided down the cable 200 to cause activation of the initiator 214, which fires the perforating gun 228.

During the foregoing time period (during which the firing heads 238 and 206 are activated), the measurement module 210 of the monitor 208 can be continuously, periodically, or intermittently taking measurements of various parameters (such as the current or voltage or both of stimuli on the cable 200). Thus, the measurement module 210 is able to measure the voltage and/or current before, during, and after activation of the initiator 236 in the firing head 238. Similarly, the measurement module 210 is able to monitor the parameters of the cable 200 before, during, and after activation of the initiator 214 in the firing head 206. The measured parameters are communicated over the cable 200 to either another downhole component (such as for storage in a local storage device) or to an earth surface controller for processing and presentation to well operators. Instead of measuring electrical voltage/current parameters, the monitor 208 can be used to measure other types of signaling provided in cable 200, such as optical signals or other signals.

In this way, the monitor 208 is able to monitor the quality of the electrical signal (or other stimulus) by measuring voltage, current, or other characteristics. Since the monitor 208 is mounted close to the end of the electrical transmission path (containing the cable 200), the monitor 208 is able to detect a fault in any of the subsystems through which the electrical energy is transmitted. The subsystems include the firing head, gamma ray tool, casing collar locator, cable, cable head, surface equipment sending electrical signal (or other stimulus) and so forth.

Prior to firing a perforating gun, the monitor 208 can monitor the cable 200 for noise that could indicate the presence of a fault. For example, application of a low voltage at the earth surface, well below the voltage that is needed to activate the initiator 214 or 236, allows for observation of any short circuits or other cable disturbances, especially any intermittent faults that are otherwise relatively difficult to identify. During gun firing, the voltage and current entering the initiator 214 or 236 can be monitored to provide information regarding the subsystem upstream of the monitor 208, or in the initiator 214 or 236 itself. Finally, electrical conditions after the guns have been fired can be monitored by the monitor 208 to provide information regarding what has happened after the guns have fired.

In addition to monitoring voltage or current of stimuli in the cable 200, the measurement module 210 in the monitor 208 is also able to measure timing of signaling or stimuli provided over the cable 200. Other parameters that can be measured by the monitor 208 include temperature, pressure, depth of the tool, acceleration of the tool, humidity inside the tool or other characteristics.

To communicate signaling over the cable 200 to another downhole component or to the earth surface, the monitor 208 also contains a telemetry module. If the monitor 208 is arranged such that the monitor 208 is not destroyed by activation of the explosive device, or if the perforating gun 228 fails to fire and therefore does not destroy the monitor 208, the monitor 208 can also include a non-volatile storage device for storing measurement information collected by the measurement module 210. This information can subsequently be transmitted to the earth surface over the telemetry link, or can be downloaded by recovering the tool to the surface.

Figure 3:
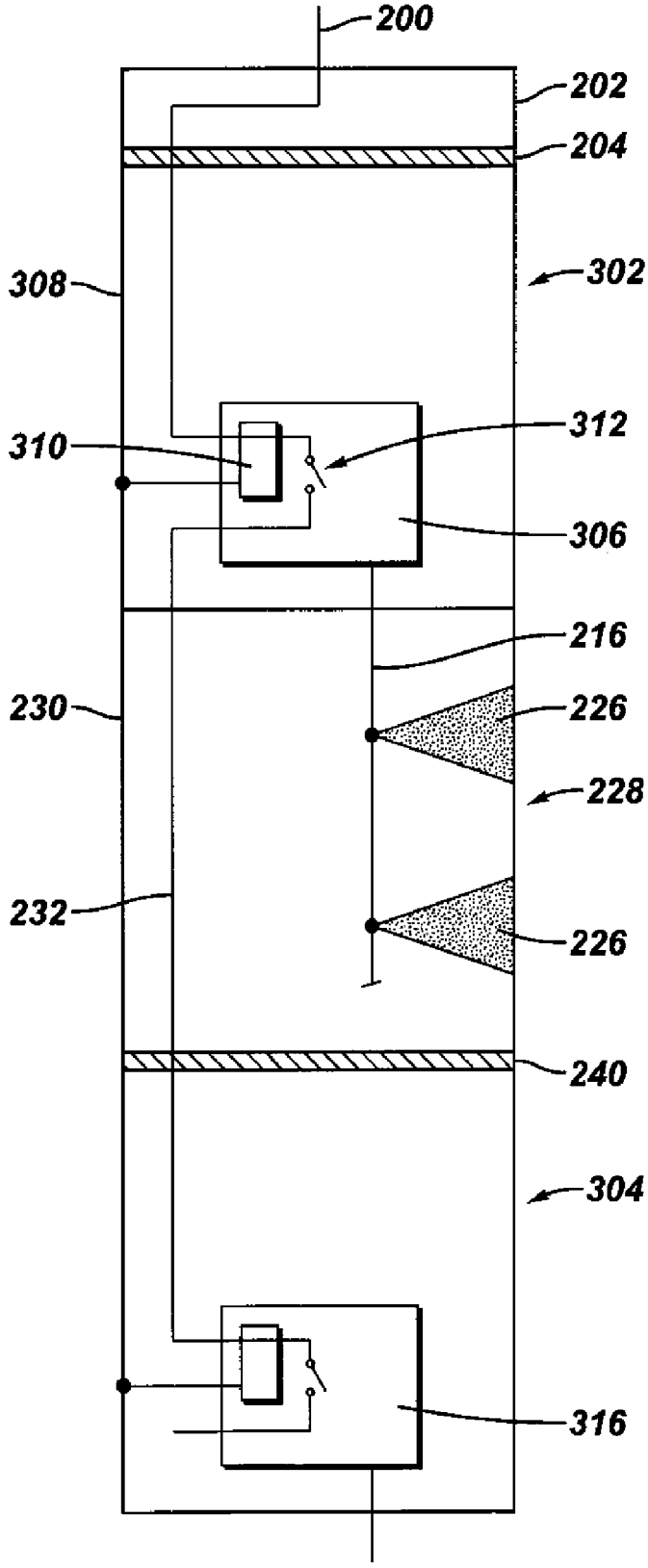
FIG. 3 illustrates a second arrangement of the tool in which a monitor is provided, in accordance with another embodiment.

FIG. 3 shows a different arrangement of a tool in which components that are the same as the components of FIG. 2 share the same reference numerals. In the FIG. 3 embodiment, the firing heads 302 and 304 are arranged differently from the firing heads 206 and 238 of FIG. 2. In the upper firing head 302, the monitor and initiator are integrated into an integrated assembly 306 that contains both the monitor and the initiator. The integrated assembly 306 is contained in a housing 308 of the firing head 302.

The integrated assembly 306 includes a measurement module 310 (part of the monitor) that measures various parameters as discussed above. The integrated assembly 306 includes a cable switch 312 that when closed allows stimuli to be provided through the cable switch 312 and the cable segment 232 to an integrated assembly 316 of the lower firing head 304. The integrated assembly 316 is arranged identically to the integrated assembly 306. Each of the integrated assemblies 306 and 316 also includes an addressable switch integrated with an initiator (not shown), in some implementations. Signaling containing a unique address of the addressable switch in the integrated assembly 306 or 316 is provided over the cable 200 to activate the corresponding initiator in the respective integrated assembly 306 or 316.

In the embodiment of FIG. 3, note that a measurement module 306 and 316 is provided in each of the firing heads 302 and 304 so that a local measurement module can be used to monitor stimuli provided to the respective firing head 302 or 304.

Figure 4:
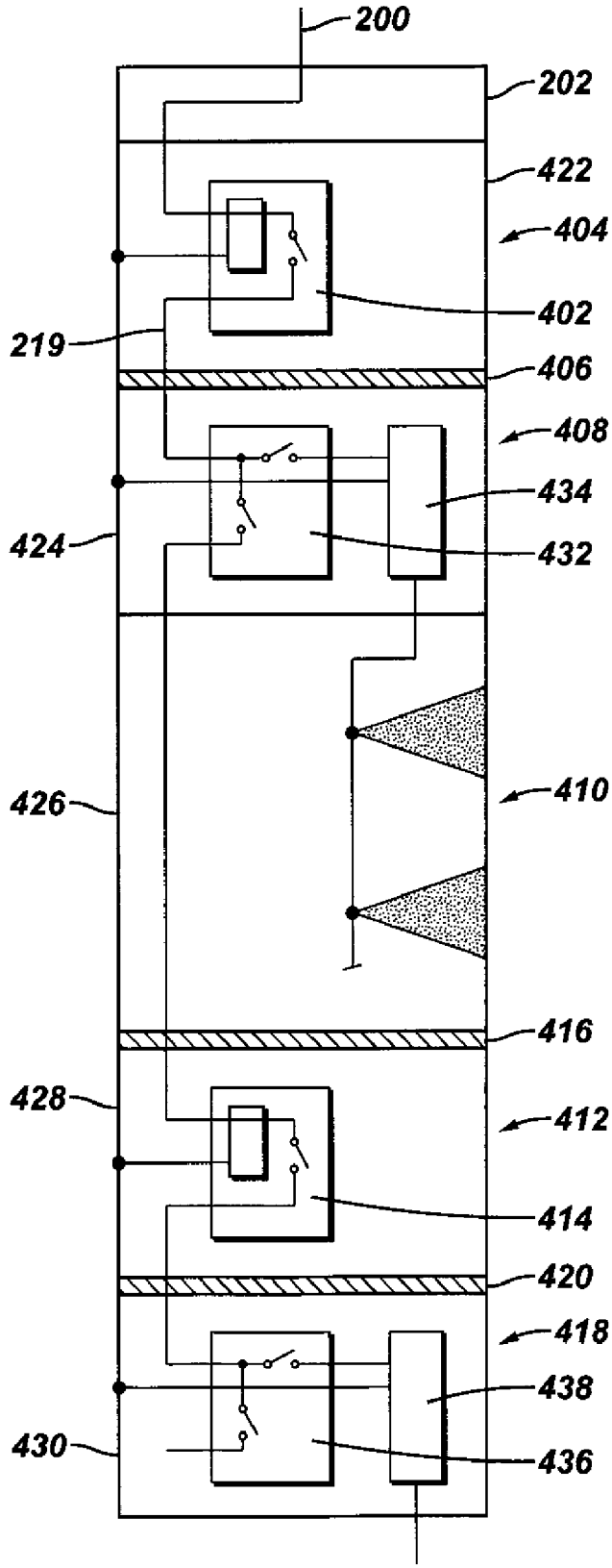
FIG. 4 illustrates yet another arrangement of the tool in which a monitor is provided, in accordance with a further embodiment.

FIG. 4 shows yet another arrangement of a tool. In this arrangement, a first monitor 402 is provided in an upper monitor module 404 that is separated by a pressure bulkhead 406 from an upper firing head 408. The first monitor 402 is located in a housing 422 of the monitor module 404. The pressure bulkhead 406 is used to protect the monitor 402 such that the monitor 402 is not destroyed by activation of the firing head 408 and perforating gun 410.

Also, a lower monitor module 412 (located further down in the tool) contains a monitor 414 (located within a housing 428 of the monitor module 412) that is isolated from the perforating gun 410 by a pressure bulkhead 416 and isolated from a lower firing head 418 by a pressure bulkhead 420.

The monitors 402 and 414 are the same as the monitor 208 in FIG. 2. FIG. 4 shows housing 424, housing 426, and housing 430. Also, the firing head 408 contains an addressable switch 432 and an initiator 434 that are arranged in the same manner as the addressable switch 220 and initiator 214 of FIG. 2. An addressable switch 436 and initiator 438 of the firing head 418 are also arranged in the same way as the addressable switch 220 and initiator 214 of FIG. 2. Other implementations may not use an addressable switch. If a single perforating gun is to be fired, the initiator can be directly connected to the monitor through a control line segment. If multiple perforating guns are to be fired, other types of devices can be used in place of the addressable switch; these include a diode that allow only the correct polarity of shooting voltage to reach initiator, or a mechanical switch that connects initiator to the monitor upon sensing the mechanical acceleration resulting from the firing of firing head.

Each of the monitors 402 and 414 is used to monitor a shooting voltage or current provided over the cable 200 from a remote source at the earth surface or some other remote location of the wellbore. In other words, the monitors 402 and 414 are not located in modules that are also used for generating shooting voltage or current for activating respective firing heads 408 and 418. The monitors 402 and 414 thus can operate independently of a source of the shooting voltage or current. In this manner, the monitor modules 402 and 412 are relatively inexpensive modules that can be easily and conveniently attached to a tool that includes explosive device(s).

The reusable feature of the monitor of the FIG. 4 arrangement allows the monitors to be reused for future operations, which helps to reduce costs associated with equipment for wellbore operations.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An explosive device comprising:

a housing;

an initiator in the housing, an explosive in the housing, the explosive being activated by the initiator, a control line connecting from outside the housing to the initiator;

the initiator being activatable in response to a stimulus transmitted from outside the housing along the control line to the initiator thereby actuating the initiator; and a monitor in the housing that monitors a state of the stimulus to enable determination of a status of the explosive device, wherein the stimulus comprises at least one selected from: a shooting voltage and a shooting current.

2. The explosive device of claim 1, further comprising a firing head, the firing head comprising the housing and the initiator.

3. The explosive device of claim 2, further comprising a perforating gun coupled to the firing head, the perforating gun activatable by the firing head.

4. The explosive device of claim 2, wherein the initiator comprises a detonator.

5. The explosive device of claim 1, further comprising a gun, the gun comprising the housing and the explosive.

6. The explosive device of claim 1, wherein the housing further contains an addressable switch associated with a unique address.

7. The explosive device of claim 6, further comprising:

a first firing head, the first firing head comprising the housing that contains the addressable switch and the initiator; and a second firing head, the second firing head comprising a second housing containing another addressable switch and another initiator.

8. The explosive device of claim 1, the monitor to further measure a downhole characteristic of the wellbore, the downhole characteristic comprises at least one selected from: temperature, humidity, pressure, depth, and acceleration.

9. The explosive device of claim 1, wherein the monitor has a switch that when closed connects the control line to another control line segment.

10. The explosive device of claim 1, wherein the monitor includes a telemetry device to communicate over the control line.

11. The explosive device of claim 1, the monitor to measure shooting power originated by a remote source, the shooting power provided over the control line from the remote source to the explosive device.

12. The explosive device of claim 1, wherein the stimulus comprises at least one selected from: the shooting voltage, the shooting current and an optical signal.

13. The explosive device of claim 1, wherein the monitor includes a measurement module to measure the stimulus and at least one additional parameter.

14. The explosive device of claim 13, wherein the at least one additional parameter measured by the measurement module includes at least one parameter selected from among temperature, depth of the tool, acceleration of the tool, and humidity level.

15. The explosive device of claim 14, wherein the monitor further comprises a storage device to store the measured stimulus and the at least one additional parameter.

16. The explosive device of claim 1, wherein the monitor is to monitor the state of the stimulus before, during, and after activation of the explosive device.

17. The explosive device of claim 1, wherein the monitor is to communicate the state of the stimulus over the control line to an earth surface controller.

18. The device of claim 1, wherein the explosive detonates.

19. The device of claim 1, wherein the explosive bums.

20. A method comprising:

lowering, on a carrier line, a tool containing an explosive device into a wellbore, the explosive device comprising an explosive;

providing a monitor in a housing of the explosive device, the explosive device further containing an initiator;

providing an electrical stimulus that is transmitted over a line to the explosive device, the line connecting from outside the housing to the explosive device; and measuring the electrical stimulus by the monitor to determine a status of the explosive device.

21. The method of claim 20, further comprising communicating an indication of a measurement of the stimulus over the cable to a remote device.

22. The method of claim 20, further comprising measuring at least one other characteristic of a downhole environment of the explosive device.

23. The method of claim 22, wherein measuring the at least one other characteristic comprises measuring at least one selected from: temperature, humidity, pressure, depth, and acceleration.

24. The method of claim 20, wherein measuring the electrical stimulus comprises measuring at least one selected from: a voltage and a current in the cable.

25. The method of claim 24, wherein measuring at least one selected from: the voltage and the current comprises measuring such before, during, and after activation of the explosive device.

26. The method of claim 24, wherein the measuring at least one selected from: the voltage and the current, comprises measuring such before and during activation of the explosive device.

27. The method of claim 20, comprising providing one selected from: the electrical stimulus and an optical signal.

28. The method of claim 20, further comprising storing the measured electrical stimulus in a storage device of the monitor.

29. The method of claim 28, further comprising:

measuring, by the monitor, at least one other parameter; and storing the measured electrical stimulus and at least one other parameter in the storage device.

30. The method of claim 20, further comprising communicating the measured electrical stimulus over the cable to an earth surface controller.

31. The method of claim 20, wherein the explosive detonates.

32. The method of claim 20, wherein the explosive burns.

* * * * *